US006145221A

United States Patent [19]

Hockerson

[11] Patent Number: 6,145,221

[45] Date of Patent: Nov. 14, 2000

[54] CLEATED ATHLETIC SHOE

[76] Inventor: Stan Hockerson, 6718 Mossman Pl. NE., Albuquerque, N. Mex. 87110

[21] Appl. No.: 09/308,050

[22] PCT Filed: Nov. 12, 1997

[86] PCT No.: PCT/US97/20504

§ 371 Date: May 11, 1999

§ 102(e) Date: May 11, 1999

[87] PCT Pub. No.: WO98/20763

PCT Pub. Date: May 22, 1999

Related U.S. Application Data

[60] Provisional application No. 60/030,143, Nov. 12, 1996.

[51] Int. Cl.[7] ..... A43B 5/02; A43C 15/16

[52] U.S. Cl. ..... 36/126; 36/128; 36/67 R

[58] Field of Search ..... 36/126, 128, 67 R, 36/67 A, 67 B

[56] References Cited

U.S. PATENT DOCUMENTS

| | | |
|---|---|---|
| 2,032,596 | 3/1936 | Shannon . |
| 2,070,269 | 2/1937 | Goldenberg . |
| 2,471,113 | 5/1949 | Melchionna . |
| 2,918,733 | 12/1959 | Anderson . |
| 3,043,026 | 7/1962 | Semon . |
| 5,179,791 | 1/1993 | Lain . |
| 5,426,873 | 6/1995 | Savoie . |

*Primary Examiner*—Ted Kavanaugh

*Attorney, Agent, or Firm*—Flehr Hohbach Test Albritton & Herbert LLP; Richard E. Backus

[57] ABSTRACT

A cleated athletic shoe (18) incorporating a cleat frame (22) having cleat supports (52) which extend down through openings formed in a sole (20). The cleat supports (52) carry cleats (26–36) having portions which extend below the bottom surface of the sole (20) for providing traction on a player surface. The cleated supports (52) are coupled to the cleat frame (22) in a manner which transfers upward forces from the cleat (26–36) into the cleat frame (22) when the shoe is weighted.

15 Claims, 3 Drawing Sheets

CLEATED ATHLETIC SHOE

CROSS REFERENCE TO RELATED APPLICATION

This is a 371 of PCT/US97/20504 filed on Nov. 12, 1997, in which the PCT is claiming priority of Provisional Application No. 60/030,143 filed on Nov. 12, 1996.

BACKGROUND OF THE INVENTION

1. Field of the Invention

This invention relates in general to footwear, and more particularly to athletic shoes with cleats for sports such as baseball, football, soccer and rugby.

2. Description of the Related Art

Participants in sports such as baseball, football, soccer and rugby wear cleated athletic shoes for traction on the playing field. FIG. 1 illustrates a typical prior art baseball shoe 12 in which blade-like cleats 14, 16 are mounted below the shoe's outsole. The outsole is usually made of a hard polymer material which embeds a plurality of internally threaded housings. The cleats are replaceable by forming their upper ends with external threads which screw into the housings. Shoes for use in football, soccer and rugby are provided with truncated conical cleats.

When a cleated athletic shoe is weighted, such as when the user runs over the playing field, the cleats push upwardly against the outsole. The outsole reacts by deforming and pressing upwardly against the bottom of the user's foot. This undesirably creates a condition known as "point loading" on the user's foot at the cleat locations. Over a period of repeated use, this point loading can result in foot discomfort and fatigue. This has been a continuing source of complaints from athletes, both professional and amateur, who wear cleated athletic shoes. The point loading can also result in physiological injuries, such as plantar fasciitis, plantar warts, metatarsal problems and bone spurs.

The prior art cleated athletic shoes have a number of other shortcomings and disadvantages. The shoes are relatively stiff and rigid because of the requirement to mount the cleats into the hard polymer material which forms the outsole. The prior art cleated shoe design also results in relatively heavy shoes, which can detract from the athlete's performance. Athletes wearing the shoes also complain that the shoes need more cushioning.

OBJECTS AND SUMMARY OF THE INVENTION

It is a general object of the present invention to provide a new and improved cleated athletic shoe which obviates the problems of point loading that can occur on the user's foot above the cleat locations.

Another object is to provide a cleated athletic shoe of the type described which is more flexible and is lighter in weight than prior art cleated shoes.

The invention in summary provides a cleated athletic shoe incorporating a cleat frame mounted above the top surface of the shoe's sole. Cleat supports on the frame extend down through openings formed in the sole. Cleats carried by the cleat support extend below the bottom surface of the sole where they provide traction on a playing surface. When the shoe is weighted by the user, upward forces from the cleat are transferred into the cleat frame for shielding the user's foot from the problems of point impact loading.

The foregoing and other objects and features of the invention will appear from the following specification in which the several embodiments have been described in conjunction with the accompanying drawings.

DESCRIPTION OF THE PREFERRED EMBODIMENTS

Figure 1:
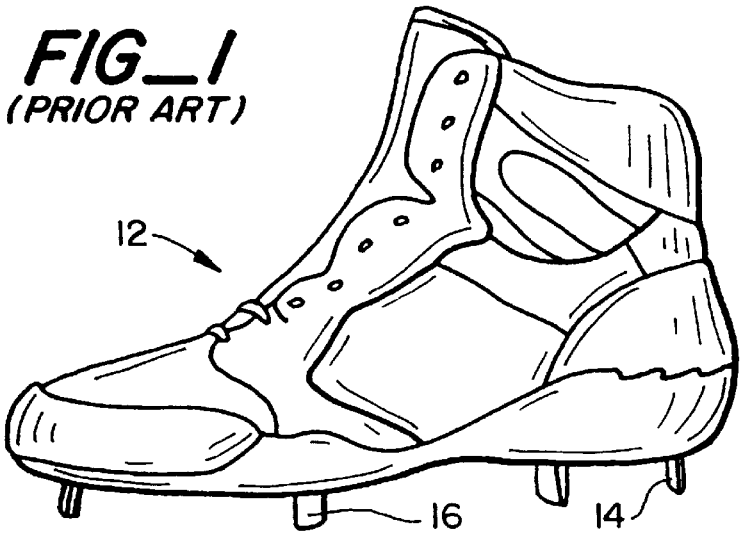
FIG 1 (PRIOR ART)
FIG. 1 is a side elevation view of a prior art cleated athletic shoe.
Figure 2:
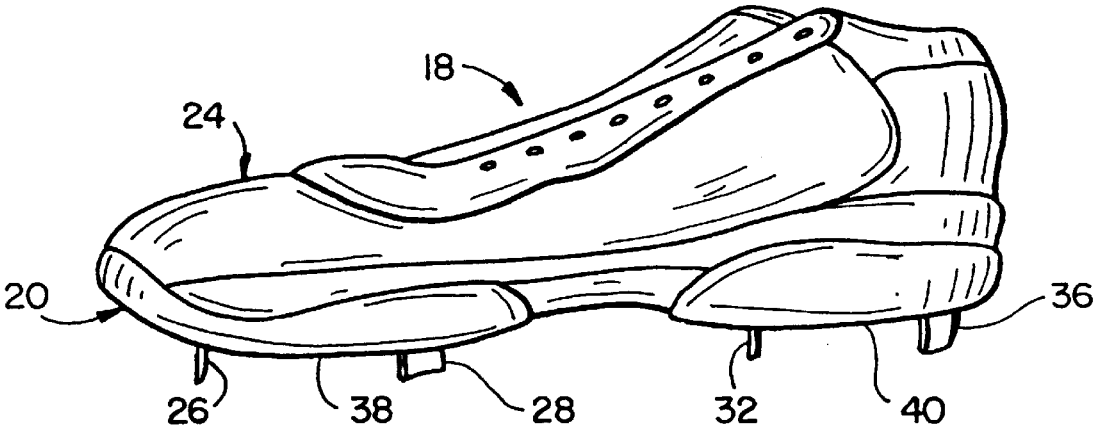
FIG. 2 is a side elevation view of a cleated athletic shoe in accordance with one embodiment of the invention.
Figure 3:
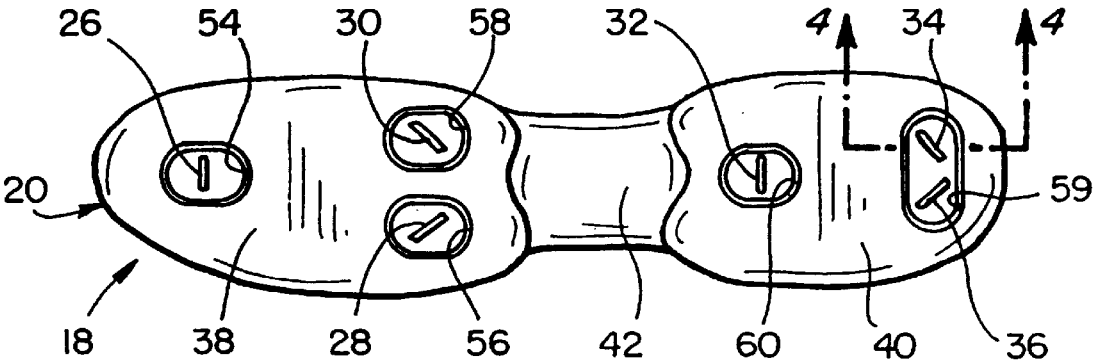
FIG. 3 is a bottom plan view of the shoe of FIG. 2.

In the drawings FIGS. 2 and 3 illustrate generally at 18 a cleated athletic shoe in accordance with one preferred embodiment of the invention. The principal components of shoe 18 comprise a sole 20, a cleat frame 22 (best shown in FIG. 5), an upper 24 and a plurality of cleats 26–36.

Figure 4:
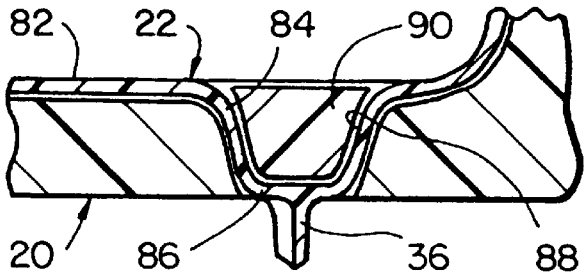
FIG. 4 is a fragmentary cross sectional view, to an enlarged scale, taken along the line 4—4 of FIG. 3.

Athletic shoe 18 is specially adapted for use in the sport of baseball. In this sport the desired shape of the cleats is blade-like, as best shown in FIG. 4 for the heel cleat 36. It is understood that the invention has application in cleated athletic shoes for other sports, such as football, soccer or rugby, where the cleats are in the form of spike-shaped truncated cones.

In the illustrated embodiment where the shoe 18 is adapted for baseball, sole 20 has a forefoot portion 38 with a single blade-like cleat 26 transversely positioned near the toe area and a pair of like cleats 28 and 30 which are at 45° positions of the shoe's longitudinal axis at the area below the metatarsal heads of the user's foot. The shoe further includes a heel portion 40 having a pair of blade-like cleats 34–36, also at 45° positions from the longitudinal axis, below the user' heel bone and a single like cleat 32 extending transversely at a position toward the instep 42 of the shoe. The cleats are carried from cleat frame 22 by means of a plurality of cleat supports 44–52. The cleat supports project down through a plurality of respective openings 54–60 which are formed through sole 20. These openings penetrate down through the sole and are sized to snugly fit about the cleat supports. As used herein, "opening" also includes cut outs or indentations which extend inwardly from the outer margins of the sole.

While the illustrated embodiment shows separate forefoot and heel portions, the invention contemplates shoe designs in which the forefoot and heel portions merge together at the instep area. In addition, the invention contemplates an outsole mounted below sole 20 with the outsole also being formed with a plurality of openings which register with openings 54–60.

Preferably sole 20 is formed of EVA (ethylvinylacetate) or similar cushioning material, such as rubber composite or other synthetic polymer, including twin sheet forming materials.

Figure 5:
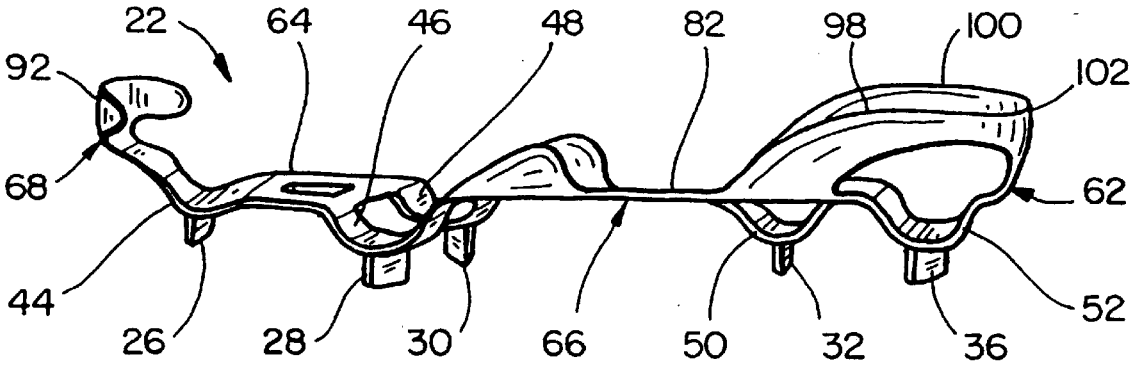
FIG. 5 is a perspective view of the cleat frame which is a component of the shoe of FIG. 2.
Figure 6:
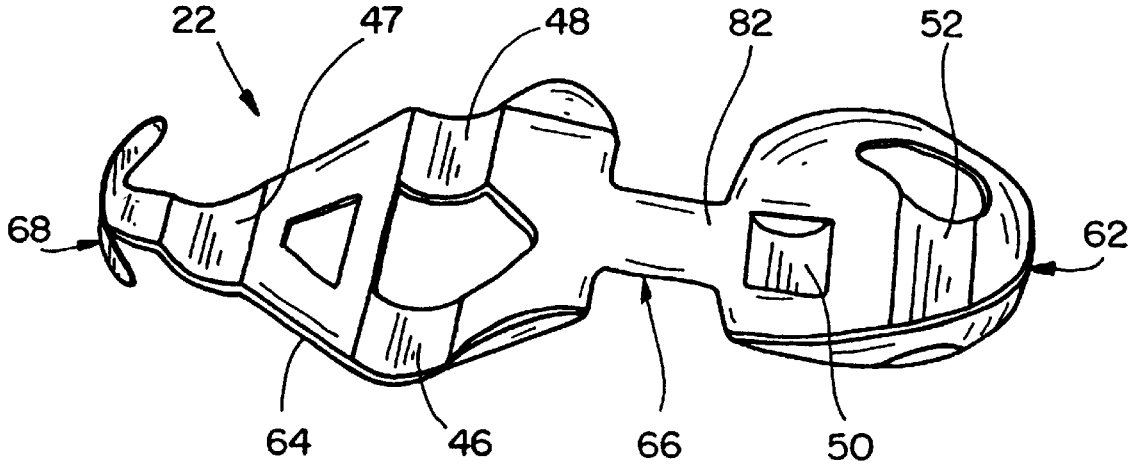
FIG. 6 is a perspective view similar to FIG. 5 from a high view point illustrating the top of the cleat frame.
Figure 7:
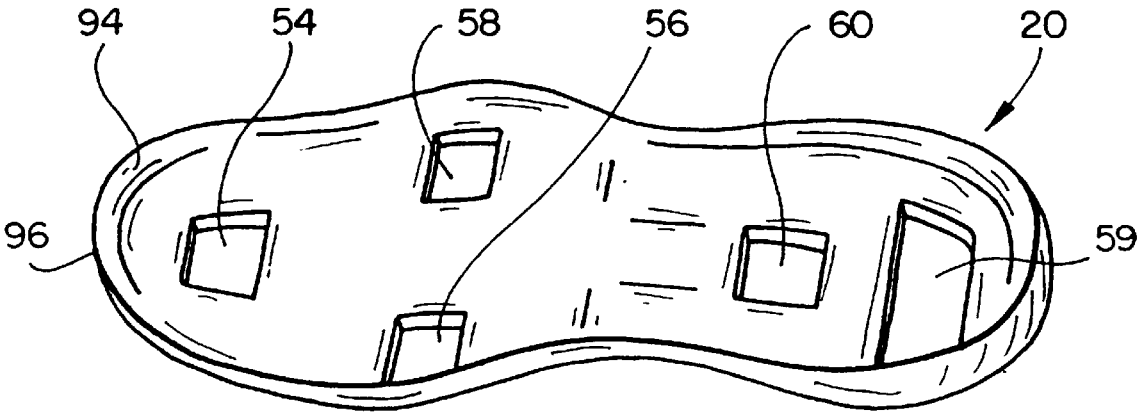
FIG. 7 is a perspective view of the sole which is a component of the shoe of FIG. 2.

Cleat frame 22 is shown in detail in FIGS. 5 and 6 and comprises a heel part 62 which is integrally formed with cleat supports 52 and 50, a forefoot part 64 which is integrally formed with cleat supports 46 and 48 and which is integrally joined with the heel part by means of a shank 66, and a toe shield 68 which is integrally joined with cleat support 44 in the toe area.

Cleat frame 22 is formed of a suitable material which is light in weight and strong, such as composite graphite, a metal such as steel or aluminum, or a synthetic polymer. In the preferred embodiment of the invention of FIGS. 2–6, the cleat frame material is a composite graphite of which the portions which form the cleat supports are impregnated with an elastic-property forming resin. The resin is added in an amount which is sufficient to provide a degree of elasticity so that the cleat supports can deform and absorb energy while the cleats are weighted and transfer the upward forces into the cleat frame. The elasticity releases the energy and restores the cleat supports to their original shapes when the cleats are unweighted. A high density impregnating resin is suitable for this purpose.

Figure 8:
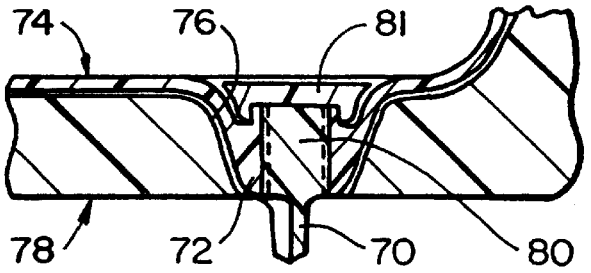
FIG. 8 is a fragmentary cross sectional view, similar to FIG. 4 and to an enlarged scale, showing a sole and cleat support structure with a replaceable cleat in accordance with another embodiment of the invention.

Also in the illustrated embodiment of FIGS. 2–6 cleats 26–36 are formed integral with the cleat frame. The cleats could also be separate parts which are secured by suitable means to the cleat supports. One example is the embodiment of FIG. 8 illustrating a cleat 70 removably mounted in cleat support 72 which is carried from cleat frame 74 and extends down through an opening 76 formed in the shoe sole 78. A cylindrical upper end 80 of the cleat is threaded for screwing into internal threads formed in opening 76. This enables the cleat to be screwed out of the opening and replaced with another cleat, as desired. A cushioning plug 81 is fitted in the depression above cleat end 80.

The lower portion of cleat frame 22 is formed with a generally flat base 82. As illustrated in FIG. 4, cleat support 52, which is typical in cross section of the six cleat supports, is comprised of a downwardly extending U-shaped wall 84 having a projecting portion 86 which is spaced below the cleat frame base. Upward forces from the cleat are transferred through wall 84 of the support structure into the cleat frame. This shields the user's foot from the point impact loading that would otherwise occur from the upward pressure of a cleat against the bottom of the user's foot. During this upward transfer of forces, the cleat support wall also elastically deforms as described above.

When a user's foot shod with shoe 18 strikes the ground and the cleats penetrate down into the underlying grass, soil or artificial turf, the impact of the forces are absorbed through the cleat frame which is cushioned by material of sole 20. The elasticity of the sole also absorbs energy during the loading phase of the gait cycle, and a portion of this energy is released back into the user's foot when the shoe is unweighted.

In the illustrated embodiment of FIGS. 2–7 the cleat supports 44–50 have a generally rectangular shape with each support carrying one cleat. Cleat support 52 at the heel is also rectangular but is oriented transverse of the shoe. This support carries two cleats 34 and 36. Similar rectangular shaped cavities 88 are formed between the sidewalls of each cleat support. These cavities are filled in by similar shaped plugs 90 which are formed of a suitable shock absorbing material such as EVA. Where the upper is slip lasted, the bottom wall of the upper would overlie the upper surface of the cleat frame as well as the plugs. The shoe could also be formed with an insole, not shown, overlying the cleat frame and plugs.

Toe shield 68 is formed with an outwardly convex front surface 92 which interfits with the curved inner surface 94 of an upwardly extending toe portion 96 which is integrally formed with the sole. The toe shield of the cleat frame and the toe portion of the sole obviate the problem of toe drag typically encountered when the shoes are worn by baseball pitchers. The provision of the toe shield being integral with the cleat frame also obviates the need for providing a separate toe plate, which would add unneeded weight to the shoe.

Heel portion 62 of the cleat frame is formed with laterally spaced-apart sides 98, 100 which are joined together at the rear by a U-shaped portion 102. The surface area provided by these components of the heel enable the frame to be securely glued to the upper.

Figure 9:
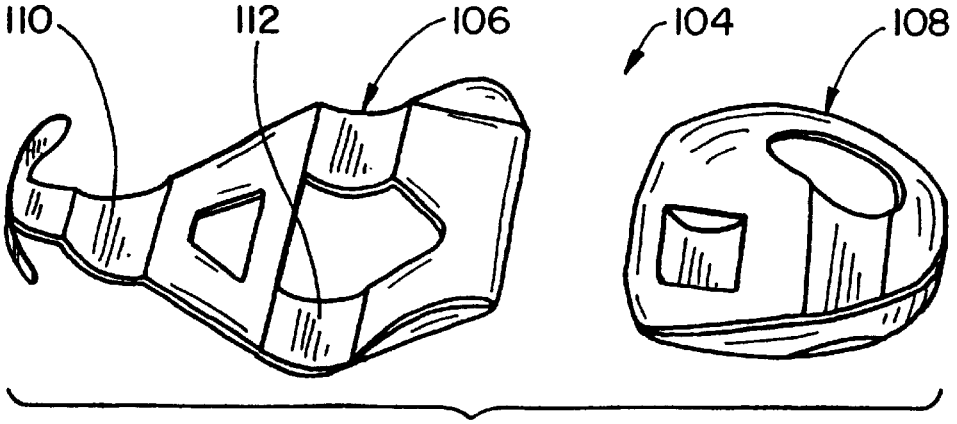
FIG. 9 is a perspective view of a cleat frame in accordance with another embodiment of the invention.

Shank 66 rigidly holds the forefoot and heel portions of the cleat frame together. The rigidity of the shank prevents angulation between the forefoot and heel portions, thereby obviating the problem of plantar fasciitis. The invention also contemplates the embodiment of FIG. 9 in which a cleat frame 104 is formed with a forefoot portion 106 and heel portion 108 which are separate and not joined by shank. Cleat frame 104 is formed with cleat support structures 110, 112 that carry cleats (not shown) which extend down through openings that penetrate through a cushioning sole in the manner explained in the embodiment of FIGS. 2–6. The cleat frame 104 with independent forefoot and heel portions could be used with a shoe in which the sole has an instep area that is sufficiently rigid to prevent angulation between the forefoot and heel portions.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A cleated athletic shoe which comprises a sole having a top surface and a bottom surface, at least one opening penetrating through the sole, a cleat frame mounted above the top surface, and a cleat support for supporting at least one cleat in a position at which at least a portion of the cleat is below the bottom surface, the cleat support being in register with the opening, the cleat support being carried by the cleat frame, the cleat support comprising an elastic generally U-shaped wall having a lower downwardly convex portion projecting through the opening of the sole and the wall is sufficiently elastic to deform and transfer upward forces from the cleat into the cleat frame when the shoe is weighted by the user for shielding the user's foot from point impact loading.

2. An athletic shoe as in claim 1 in which the cleat frame comprises a base, and the wall has a projecting portion which is spaced below the base for carrying said cleat with the cleat support structure transferring the upward forces from the cleat to the base.

3. An athletic shoe as in claim 1 which further comprises a cleat, the cleat is attached to the cleat support.

4. An athletic shoe as in claim 3 in which the cleat is releasably attached to the cleat support.

5. An athletic shoe as in claim 3 in which the cleat is integral with the cleat support.

6. An athletic shoe as in claim 1 in which the sole has a forefoot portion, a heel portion and a shank portion between the forefoot and heel portions, and the shank portion of the cleat frame extends along the instep portion.

7. An athletic shoe as in claim 1 in which the shank portion comprises an elongate substantially rigid strip having front and rear end portions which are joined respectively with the forefoot and heel portions of the cleat frame.

8. An athletic shoe as in claim 1 in which the wall extends along a path which is convex in a direction outwardly from the bottom surface of the sole.

9. An athletic shoe as in claim 1 which further comprises an upper mounted above the cleat frame.

10. An athletic shoe as in claim 1 in which the sole has a forefoot portion and a heel portion, the cleat frame has a forefoot portion and a heel portion which are positioned above the respective forefoot and heel portions of the sole, said one opening penetrating through the forefoot portion of the sole, and the cleat support is carried below the forefoot portion of the cleat frame.

11. An athletic shoe as in claim 1 and further characterized in that the sole has a forefoot portion and a heel portion, the cleat frame has a forefoot portion and a heel portion which are positioned above the respective forefoot and heel portions of the sole, said one opening penetrates through the forefoot portion of the sole, the first mentioned cleat support is carried below the forefoot portion of the cleat frame in register with the one opening, the sole has an other opening penetrating through the heel portion of the sole, and a second cleat support carried below the heel portion of the cleat frame for supporting an other cleat in register with the other opening.

12. An athletic shoe as in claim 1 and further comprising first and second cleats supported by the cleat support, and the first and second cleats are positioned in side-by-side relationship in register with the opening.

13. An athletic shoe as in claim 1 in which the cleat support has sufficiently elasticity to enable the cleat support to deform and absorb a portion of the upward forces from the cleat responsive to the shoe being weighted by the user.

14. An athletic shoe as in claim 13 in which the cleat support is integral with the cleat frame, and the cleat frame is comprised of a composite graphite material with the material in the cleat support being impregnated with an elastic-property forming resin in an amount which is sufficient to provide said elasticity.

15. An athletic shoe as in claim 1 and further characterized in that the sole has a forefoot portion and a heel portion, the first mentioned cleat frame is mounted above the forefoot portion with the first mentioned cleat support being coupled with the first mentioned cleat frame, the one opening penetrating through the forefoot portion, a second opening penetrating through the heel portion, together with a second cleat frame mounted above the heel portion, and a second cleat support for supporting an other cleat in a position at which at least a portion of the other cleat is below the bottom surface, the second cleat support being coupled to the second cleat frame for transferring upward forces from the other cleat into the second cleat frame when the shoe is weighted by the user for shielding the user's foot from point impact loading.

* * * * *